US008499955B2

(12) United States Patent
Vazquez et al.

(10) Patent No.: US 8,499,955 B2
(45) Date of Patent: Aug. 6, 2013

(54) TECHNIQUES FOR AT LEAST ONE OF TRANSPORT, STORAGE, AND DISPLAY OF ONE OR MORE ITEMS OF AT LEAST ONE OF APPAREL AND ACCESSORIES

(75) Inventors: Kristin Marie Raffone Vazquez, Draper, UT (US); Robert Gooch, Orem, UT (US); Douglas D. Stout, Orem, UT (US)

(73) Assignee: Kristin Marie Raffone Vazquez, South Jordan, UT (US)

( * ) Notice: Subject to any disclaimer, the term of this patent is extended or adjusted under 35 U.S.C. 154(b) by 89 days.

(21) Appl. No.: 12/941,950

(22) Filed: Nov. 8, 2010

(65) Prior Publication Data

US 2011/0192840 A1 Aug. 11, 2011

Related U.S. Application Data

(60) Provisional application No. 61/259,102, filed on Nov. 6, 2009.

(51) Int. Cl.
*B65D 85/18* (2006.01)
*B65D 71/00* (2006.01)

(52) U.S. Cl.
USPC ..... 220/4.22; 220/23.88; 220/500; 220/507; 220/520; 220/23.4; 206/278; 206/287; 206/290; 206/292; 206/736; 206/737; 206/745; 206/504; 206/765; 206/45.2; 206/750; 206/742; 190/19; 190/100; 190/13 F; 190/16; 190/36; 221/34; 221/35; 221/36; 221/37; 221/42

(58) Field of Classification Search
USPC ..... 206/278, 287, 290, 292, 736, 737, 206/745, 504, 765, 756, 45.2, 750, 742; 190/19, 190/100, 13 F, 16, 36, 109, 110; 211/34, 211/35, 36, 37, 38, 42; 221/42; D3/289, 269, D3/302; 229/112, 117.14; 220/23.88, 507, 220/500, 520, 7, 23.4
IPC ..... B65D 85/18,71/00
See application file for complete search history.

(56) References Cited

U.S. PATENT DOCUMENTS 193,366 A * 7/1877 Dreyfus ..... 206/45.2
443,397 A * 12/1890 Mack ..... 229/115

(Continued)

FOREIGN PATENT DOCUMENTS

WO 03/026985 A1 4/2003

*Primary Examiner* — Mickey Yu
*Assistant Examiner* — Gideon Weinerth
(74) *Attorney, Agent, or Firm* — Jefferson IP Law, LLP; Raymond B. Persino

(57) ABSTRACT

An apparatus for at least one of the transport, storage, and display of one or more items of at least one of apparel and accessories is provided. The apparatus includes at least one crib defined by a bottom plate, a back plate, and first and second side plates, each of the at least one crib for having disposed therein one or more items of at least one of apparel and accessories. The at least one crib includes the bottom plate that is one of square and rectangular in shape, the back plate that is one of square and rectangular in shape, and the first and second side plates that have the same shape and that are facing each other. Each of the back plate and first and second side plates are perpendicular to the bottom plate. One edge of each of the back plate and first and second side plates is coupled to a respective one edge of the bottom plate. One edge of each of first and second side plates is coupled to a respective one edge of the back plat. An opening of the crib is defined by one edge of each of the bottom plate, the back plate, and the first and second side plates.

17 Claims, 11 Drawing Sheets

U.S. PATENT DOCUMENTS 776,042 A * 11/1904 Acheson ..... 206/745
798,768 A * 9/1905 Dunning ..... 190/16
1,447,145 A 2/1923 Morell
1,501,016 A * 7/1924 Young ..... 206/765
1,524,879 A * 2/1925 Rippenbein ..... 206/742
1,764,251 A * 6/1930 Farago ..... 206/749
1,921,110 A * 8/1933 Wheary ..... 206/293
1,929,490 A * 10/1933 Golden ..... 206/772
1,950,242 A * 3/1934 Hollingshead ..... 190/16
1,968,580 A * 7/1934 Wheary ..... 206/292
D106,164 S 9/1937 Wilt
D140,985 S * 4/1945 Sawyer ..... D9/632
2,446,366 A * 8/1948 Epps ..... 206/749
2,457,291 A * 12/1948 Wenzel ..... 206/45.29
D152,653 S 2/1949 Rinehart
2,634,835 A 4/1953 Mayers
2,698,689 A * 1/1955 Novack ..... 211/34
2,816,628 A * 12/1957 Garfield ..... 190/16
2,874,813 A * 2/1959 Bunte ..... 190/109
2,943,899 A 7/1960 Beller
3,001,650 A * 9/1961 Keymer ..... 211/34
3,063,550 A * 11/1962 Boden et al. ..... 206/296
3,300,038 A 1/1967 Theberge et al.
3,397,771 A * 8/1968 Fogle ..... 206/750
3,552,576 A * 1/1971 Lahr ..... 211/36
3,592,344 A * 7/1971 Schade ..... 211/42
3,664,494 A * 5/1972 Mergens ..... 206/45.22
3,669,276 A 6/1972 Woods
3,858,693 A 1/1975 Dubenko
4,083,483 A 4/1978 Bayless
4,244,509 A * 1/1981 Dlugopolski ..... 206/509
4,267,905 A 5/1981 Stewart et al.
4,269,348 A * 5/1981 Young ..... 229/115
4,460,094 A 7/1984 Schoen
4,699,267 A 10/1987 Burke
D293,626 S * 1/1988 Beran ..... D3/290
4,795,029 A 1/1989 Campbell
4,881,637 A 11/1989 Peters et al.
5,024,408 A * 6/1991 Magee ..... 248/206.5
5,118,176 A 6/1992 Motley, Sr.
5,211,460 A 5/1993 Liu
5,322,159 A * 6/1994 Houlihan ..... 206/45.2
5,456,353 A 10/1995 Challoner et al.
5,509,170 A * 4/1996 LoFaro et al. ..... 15/265
5,564,539 A * 10/1996 Duensing ..... 190/107
D375,628 S 11/1996 Williamson
5,690,261 A 11/1997 Moore
5,984,114 A 11/1999 Frankel
6,086,171 A 7/2000 Ashley et al.
6,305,533 B1 * 10/2001 Welty et al. ..... 206/278
6,481,574 B1 11/2002 Pakosh
6,598,948 B1 7/2003 Harmon
D485,435 S 1/2004 Coppedge et al.
6,905,027 B2 * 6/2005 Galter ..... 206/749
7,243,815 B2 * 7/2007 Coppedge et al. ..... 220/769
7,249,674 B2 7/2007 Mu et al.
7,416,065 B2 * 8/2008 Levinson et al. ..... 190/106
7,597,193 B2 * 10/2009 Meynard ..... 206/278
7,963,404 B2 * 6/2011 Shang ..... 211/36
2002/0008043 A1 1/2002 Gunter
2004/0163279 A1 8/2004 Gadson et al.
2006/0006079 A1 1/2006 Brooks
2006/0032765 A1 2/2006 Morhard et al.
2006/0096821 A1 * 5/2006 McKaba ..... 190/9
2006/0180484 A1 8/2006 Jones
2006/0185993 A1 8/2006 Wilskey et al.
2007/0000796 A1 * 1/2007 Kameoka ..... 206/278
2007/0090062 A1 * 4/2007 Girault et al. ..... 211/36
2007/0181451 A1 8/2007 Jones
2007/0241019 A1 10/2007 Crouchley
2009/0057174 A1 * 3/2009 Cesario, Jr. ..... 206/278
2012/0118838 A1 * 5/2012 Gutierrez ..... 211/34

* cited by examiner

TECHNIQUES FOR AT LEAST ONE OF TRANSPORT, STORAGE, AND DISPLAY OF ONE OR MORE ITEMS OF AT LEAST ONE OF APPAREL AND ACCESSORIES

CROSS-REFERENCE TO RELATED APPLICATION

This application claims the benefit under 35 U.S.C. §119 (e) of a U.S. Provisional application filed on Nov. 6, 2009 in the U.S. Patent and Trademark Office and assigned Ser. No. 61/259,102, the entire disclosure of which is hereby incorporated by reference.

BACKGROUND OF THE INVENTION

1. Field of the Invention

Aspects of the present invention relate to techniques for at least one of the transport, storage, and display of one or more items of at least one of apparel and accessories.

2. Description of the Related Art

The use of apparel and accessories is ubiquitous in modern society. Apparel and accessories are available in a variety of forms, examples of which include, but are not limited to, shoes, boots, purses, scarves, hats, belts, watches, sunglasses, necklaces, rings, bracelets, and broaches. Typically, apparel and accessories are made to at least partly serve an aesthetic function when worn by a user. However, that aesthetic function may extend to the apparel and accessories when those items are not being worn. For example, when those items are not being worn, it may be desirable to display such apparel and accessories. Furthermore, it may be desirable to display such apparel and accessories to better facilitate the selection of the apparel and accessories by the user.

In addition, many apparel and accessories are delicate and easily damaged. Such damage may include, but is not limited to, blemishes, scratches, scuffs, soiling, deformations, stains, and tearing. Such damage may be caused by the surface of the apparel and accessories coming into contact with foreign articles, the apparel and accessories being crushed by the foreign articles, the buildup of dust, etc. Thus, it may be desirable to store the apparel and accessories in a way that protects the apparel and accessories from harm.

Furthermore, as travel is becoming increasingly popular, the desire to transport the apparel and accessories is correspondingly increasing. However, similar to the case of storing the apparel and accessories, the apparel and accessories are at risk of damage when being transported. Therefore, it may be desirable to protect the apparel and accessories from harm while being transported. In addition, there is a desire to display and store the apparel and accessories at a traveler's destination.

Therefore, a need exists for techniques for at least one of the transport, storage, and display of one or more items of at least one of apparel and accessories.

SUMMARY OF THE INVENTION

An aspect of the present invention is to address at least the above-mentioned problems and/or disadvantages and to provide at least the advantages described below. Accordingly, an aspect of the present invention is to provide techniques for at least one of the transport, storage, and display of one or more items of at least one of apparel and accessories.

In accordance with an aspect of the present invention, an apparatus for at least one of the transport, storage, and display of one or more items of at least one of apparel and accessories is provided. The apparatus includes at least one crib defined by a bottom plate, a back plate, and first and second side plates, each of the at least one crib for having disposed therein one or more items of at least one of apparel and accessories. The at least one crib includes the bottom plate that is one of square and rectangular in shape, the back plate that is one of square and rectangular in shape, and the first and second side plates that have the same shape and that are facing each other. Each of the back plate and first and second side plates are perpendicular to the bottom plate. One edge of each of the back plate and first and second side plates is coupled to a respective one edge of the bottom plate. One edge of each of first and second side plates is coupled to a respective one edge of the back plat. An opening of the crib is defined by one edge of each of the bottom plate, the back plate, and the first and second side plates.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, like reference numerals will be understood to refer to like parts, components, and structures.

DETAILED DESCRIPTION OF EXEMPLARY EMBODIMENTS

Figure 1:
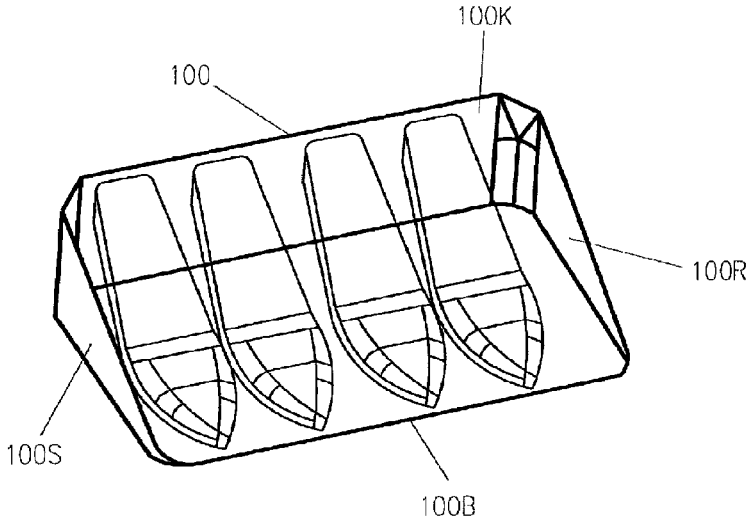
FIG. 1 is a perspective view of a crib for at least one of transport, storage, and display of one or more items of at least one of apparel and accessories according to an exemplary embodiment of the present invention.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Exemplary embodiments of the present invention relate to techniques for at least one of the transport, storage, and display of one or more items of at least one of apparel and accessories. Examples of items of at least one of apparel and accessories include, but are not limited to, shoes, boots, purses, scarves, hats, belts, watches, sunglasses, necklaces, rings, bracelets, and broaches. While the present invention is applicable to any item of at least one of apparel and accessories, for convenience in explanation, the exemplary embodiments of the present invention may be refer to one or more pairs of high-heeled shoes as an exemplary item of the at least one of apparel and accessories. In addition, while the present invention is applicable to any items of at least one of apparel and accessories, the techniques described herein may be employed for any other item, such as toiletries, books, etc., in addition to or substitution for the items of at least one of apparel and accessories.

An exemplary embodiment of the present invention is implemented as a crib for at least one of the transport, storage, and display of one or more items of at least one of apparel and accessories. An exemplary implementation of the crib is described below with reference to FIG. 1.

FIG. 1 is a perspective view of a crib for at least one of transport, storage, and display of one or more items of at least one of apparel and accessories according to an exemplary embodiment of the present invention.

Referring to FIG. 1, a crib 100 is defined by a bottom plate 100*b*, a back plate 100*k*, a first side plate 100*s*, and a second side plate 100*r*. Herein, the crib 100 is formed as a wedge shaped receptacle. The crib 100 may have disposed therein one or more items of at least one of apparel and accessories. As shown in FIG. 1, two pairs of high-heeled shoes are disposed in the crib 100.

The first side plate 100*s* and the second side plate 100*r* substantially face one another and may have substantially the same shape. In the exemplary implementation of FIG. 1, the shape of the first side plate 100*s* and the second side plate 100*r* is a triangular shape. However, the shape of the first side plate 100*s* and the second side plate 100*r* may be any other shape. The first side plate 100*s* and the second side plate 100*r* may both be substantially perpendicular to both the bottom plate 100*b* and the back plate 100*k*. Also, the bottom plate 100*b* and the back plate 100*k* may be substantially perpendicular to each other. The shape of the bottom plate 100*b* and the back plate 100*k* may be substantially the same shape or different shapes. In the exemplary implementation of FIG. 1, the shape of the bottom plate 100*b* and the back plate 100*k* is at least one of a square and a rectangular shape. However, the shape of the bottom plate 100*b* and the back plate 100*k* may be any other shape. In addition, while the bottom plate 100*b*, the back plate 100*k*, the first side plate 100*s*, and the second side plate 100*r* have been described as a plate, one side or both sides of any of one or more of the bottom plate 100*b*, the back plate 100*k*, the first side plate 100*s*, and the second side plate 100*r* may be non-planer. For example, the back plate 100*k*, the first side plate 100*s*, and the second side plate 100*r* may have a curved shape on their respective side that defines the exterior of the crib 100.

One edge of each of the back plate 100*k*, the first side plate 100*s*, and the second side plate 100*r* is coupled to a respective one edge of the bottom plate 100*b*. Also, one edge of each of the first side plate 100*s*, and the second side plate 100*r* is coupled to a respective one edge of the back plate 100*b*. In addition, an opening of the crib 100 is defined by one edge of each of the bottom plate 100*b*, the back plate 100*k*, the first side plate 100*s*, and the second side plate 100*r*.

The couplings between the bottom plate 100*b*, the back plate 100*k*, the first side plate 100*s*, and the second side plate 100*r* may employ curves, right angles, facets or any other coupling structure. In addition, reinforcement members may be employed at the coupling points of the crib 100.

In addition, the crib 100 may include a front plate (not shown) that faces the back plate 100*k* and is coupled to the bottom plate 100*b*, the first side plate 100*s*, and the second side plate 100*r*. Here, the front plate may have a dimension that is smaller than the back plate 100*k* along an axis that is perpendicular to the bottom plate 100*b*, thereby allowing the crib 100 to still have a wedge shape. While the crib 100 has been illustrated and described as a wedge shaped receptacle, the crib 100 may be implemented as a receptacle of any geometric structure. When the crib 100 is implemented using another geometric structure, the crib 100 may employ a different number of plates and/or plates of differing shapes. In addition, the crib 100 may be constructed to have any dimension. For example, the crib 100 may be wide enough to retain three pairs of high-heeled shoes or may be narrow enough to retain only a single high-heeled shoe.

As shown in FIG. 1, the crib 100 is formed as one structure. However, any number of the various plates, couplings, and reinforcement members (if implemented) may be formed separately or in combination together. In addition, any number of the various plates, couplings, and reinforcement members (if implemented) of the crib 100 may be removably attachable by a user so as to enable a user to assemble and disassemble the crib 100. The crib should be constructed of at least one of a rigid and semi-rigid material so as to have sufficient rigidity to substantially maintain its shape. The crib

100 may be constructed using one of more of wood, metal, cardboard, carbon fiber, fiberglass, leather, plastic (e.g., injection molded and vacuum formed plastic), composite materials, etc., and any combination thereof. In addition, the crib 100 may be constructed using a substantially rigid frame structure with a non-rigid material (e.g., a textile) disposed there between.

All or a portion of the crib 100 may be lined with a liner (not shown). Herein, all or a portion of the liner may be removable to facilitate cleaning or replacement. The liner may be one or more of a textile, leather, plastic, wood, metal etc., and any combination thereof. In addition, the liner may be foam backed or may cover a soft material such as batting, cotton, etc. The liner may be chosen to serve at least one of an aesthetic, a protective, and a non-skid function. When the liner is chosen to at least serve the protective function, the liner may be chosen such that the liner would mitigate damage caused to the one or more items of at least one of apparel and accessories if the liner were to come into contact with the contents of the crib 100. For example, the material for the liner may be chosen that would prevent snagging or scuffing of any part of the contents of the crib 100 that would come into contact with the liner. When the liner is chosen to at least serve the non-skid function, the liner may be chosen such that it that would mitigate skidding of the contents of the crib 100 in contact with the liner.

Also, the footwear crib may have a supplemental liner (not shown) covering various portions of the crib 100 covered by the liner in order to protect the liner or provide a non-skid function. For example, a supplemental liner may be disposed on all or a portion of the bottom plate 100*b* inside the crib 100. The supplemental liner may be one of more of a textile, leather, plastic, wood, metal etc., and any combination thereof. The supplemental liner may be removable for cleaning or replacement. When the supplemental liner is chosen to at least serve the protective function, the supplemental liner may be chosen such that it would mitigate damage caused to the contents of the crib 100 if the contents of the crib 100 were to come in to contact with the supplemental liner. For example, a material for the supplemental liner may be chosen such that it would not snag or scuff any part of the contents of the crib 100. When the supplemental liner is chosen to at least serve the non-skid function, the supplemental liner may be chosen such that it that would mitigate skidding of the contents of the crib in contact with the supplemental liner.

The crib 100 may include a locking mechanism (not shown) that fixedly or removably retains the crib 100 in a case or that attaches the crib 100 to another crib at the openings thereof. Here, the locking mechanism may employ magnets. In addition, the crib 100 may be constructed with one or more ledges or indentations (not shown) at an interior of the crib 100 that catches the contents of the crib 100. For example, in the case of high-heeled shoes, the crib 100 may include a ledge disposed on the bottom plate 100*b* to catch or retain heels of the high-heeled shoes.

The features of the crib 100 described above are applicable to any crib described herein. However, for conciseness in explanation, a description of those features may not be repeated hereafter. The crib 100 may include a retaining mechanism for securely retaining the one or more items of at least one of apparel and accessories. An exemplary implementation of the retaining mechanism is described below with reference to FIG. 2.

Figure 2:
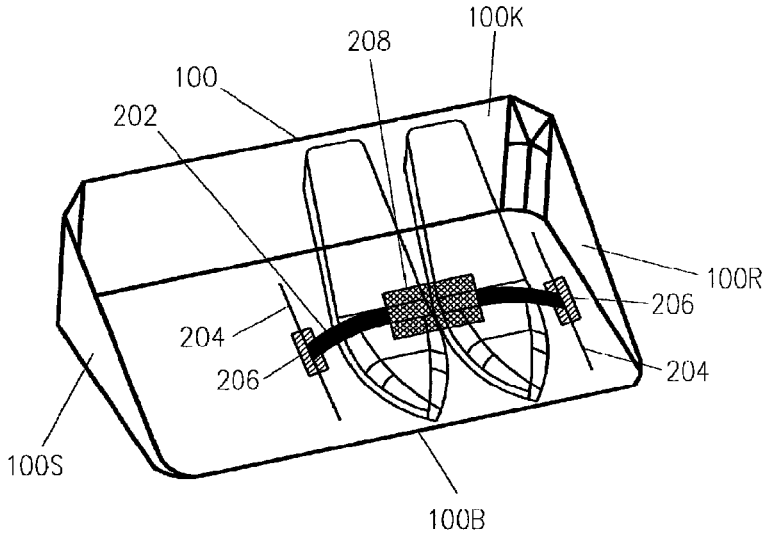
FIG. 2 is a perspective view of a crib including a retaining mechanism for retaining at least one of apparel and accessories in the crib according to an exemplary embodiment of the present invention.

FIG. 2 is a perspective view of a crib including a retaining mechanism for retaining one or more items of at least one of apparel and accessories in the crib according to an exemplary embodiment of the present invention.

Referring to FIG. 2, the crib 100 includes a retaining mechanism for securely retaining one or more items of at least one of apparel and accessories in the crib 100. Here, the one or more items of at least one of apparel and accessories include a pair of high-heeled shoes. The retaining mechanism may be implemented so as to include a strap 202 that is coupled to the crib 100 at both of its ends. Instead of the strap 202, one of a belt, a lace, a cord, a string, tape, a spring, an elastic band, etc., and any combination thereof, may alternatively be employed. While one retaining mechanism is described herein, the crib 100 may include any number of retaining mechanisms.

In the exemplary implementation shown in FIG. 2, both ends of the strap 202 are coupled to the bottom plate 100*b* of the crib 100. While both ends of the strap 202 are shown in FIG. 2 as being coupled to the bottom plate 100*b*, one or both ends of the strap 202 may be coupled to the crib 100 at another location. At least one end of the strap 202, when coupled to the bottom plate 100*b* of the crib 100, may be coupled to the bottom plate 100*b* of the crib 100 so as to be movable along a track 204 that is disposed at the bottom plate 100*b* of the crib 100. Use of the track 204 may allow for an adjustment of where the strap 202 makes contact with the contents of the crib 100. This adjustment of the location where the strap 202 makes contact with the contents of the crib 100 may mitigate any damage caused by the strap 202 to the contents of the crib 100 by the retention thereof. The track 204 may be formed so as to be substantially parallel to the first side plate 100*s* and the second side plate 100*r* of the crib 100. There may be any number of tracks disposed at the bottom plate 100*b* of the crib 100. In addition, the track 204 may be movable in a direction that is substantially parallel to the back plate 100*k* of the crib 100. Moreover, more than one strap 202 may be coupled to a track 204.

The track 204 may be formed as a rail that is disposed on the bottom plate 100*b*. Herein, when the track 204 is implemented as a rail, a sliding member 206 may be disposed on the rail that is movable along the rail and retained thereon. The sliding member 206 may be fixedly attached to one end of the strap 202. Alternatively, one end of the strap 202 may be removably coupled to the sliding member 206.

In addition, the track 204 may be formed as a slot in the bottom plate 100*b* of the crib 100. Herein, when the track 204 is implemented as a slot, the sliding member 206 may be disposed in the slot so as to be movable along the track and retained therein. The sliding member 206 may be fixedly attached to the one end of the strap 202. Alternatively, one end of the strap 202 may be removably coupled to the sliding member 206.

When the track 204 is implemented as the slot in the bottom plate 100*b* of the crib 100, instead of utilizing the sliding member 206, one end of the strap 202 may pass through the track 204 and be retained in this orientation. Here, the end of the strap 202 that passed through the track 204 may be coupled to a retainer (not shown) that prevents that end of the strap 202 from being pulled back though the track 204. The end of the strap 202 may move along the slot and may be prevented from being pulled through the slot by the retainer. Herein, the retainer may be decoupled from the strap by a user of the crib 100, and when the retainer is decoupled from the strap 202, the strap 202 may be pulled through and away from the slot. Also, the retainer may be coupled to the strap 202, by the user of the crib 100, after the strap 202 has passed though the slot. Alternatively, the retainer, while still coupled to the strap, may be manipulated by the user of the crib 100 so as to be pulled through the slot, in order for the strap to be removed from or coupled to the slot.

As an alternative to utilizing the track 204, at least one end of the strap 202, when coupled to the bottom plate 100*b* of the crib 100, may be fixedly attached to the bottom plate 100*b* of the crib 100. In addition, at least one end of the strap 202, when coupled to the bottom plate 100*b* of the crib 100, may include a retraction unit (not shown) that at least one of retracts the strap 202 when not in use and provides a retention force on the strap 202 so as to securely retain the contents of the crib 100.

Herein, the strap 202 may be formed of two sections that may be coupled to one another via a fastener (not shown). The fastener may be any of one or more snaps, Velcro, a buckle, a knot, a clip, a catch and hook, etc. The fastener may be movable along the strap 202 or may be fixedly coupled thereto.

The retaining mechanism may include a protector 208 for protecting the contents of the crib 100 from the strap 202. The protector 208 may be separate from or coupled to the strap 202. When the protector 208 is coupled to the strap 202, the protector 208 may be movable along the strap 202, fixedly disposed on the strap 202, or formed with the strap 202. When the protector 208 is separate from the strap 202, the protector 208 may be secured with Velcro, ties, etc. The protector 208 may be constructed so as to mitigate damage caused to the contents of the crib 100 by the strap 202 securing the contents of the crib 100. For example, the protector 208 may include at least one of a cushioning material (not shown) and a liner (not shown). The material of liner may be chosen so as not to snag or scuff any part of the contents of the crib 100. By way of example, the protector 208 may be implemented as one of a piece of lamb's wool wrapped in velvet, cotton-wrapped batting, etc.

The features of the crib 100 and the retaining mechanism described above are applicable to any crib described herein. However, for conciseness in explanation, a description of those features may not be repeated hereafter. The crib 100 may include a lid plate for at least one of covering an opening of the crib 100 and for causing the crib 100 to have an angled orientation with respect to a surface the crib 100 is set upon. An exemplary implementation of the lid plate is described below with reference to FIGS. 3A and 3B.

Figure 3A:
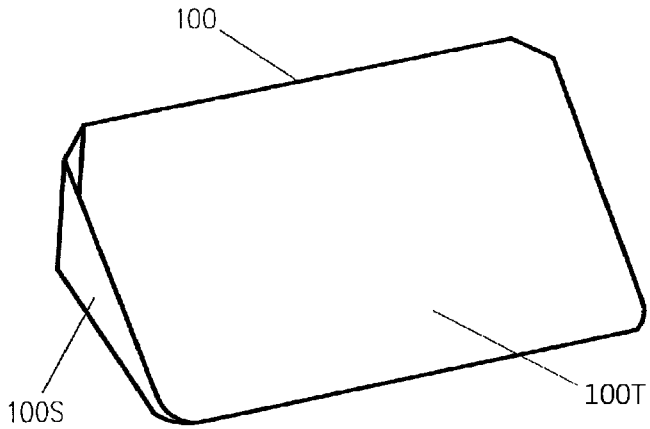
FIG. 3A is a perspective view of a crib including a lid plate in a closed position according to an exemplary embodiment of the present invention.
Figure 3B:
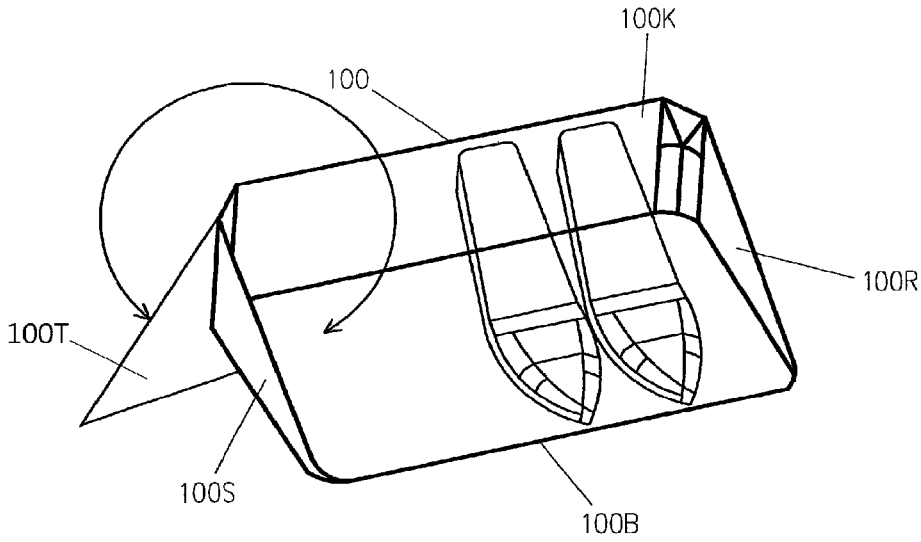
FIG. 3B is a perspective view of a crib including a lid plate in an open position according to an exemplary embodiment of the present invention.

FIGS. 3A and 3B are perspective views of a crib including a lid plate according to an exemplary embodiment of the present invention. More specifically, FIG. 3A is a perspective view of a crib including a lid plate in a closed position according to an exemplary embodiment of the present invention. FIG. 3B is a perspective view of a crib including a lid plate in an open position according to an exemplary embodiment of the present invention.

Referring to FIGS. 3A and 3B, the crib 100 includes a lid plate 100*t*. The lid plate 100*t* may be rotatably coupled to the crib 100. Herein, the lid plate 100*t* may be rotatably coupled to the back plate 100*k* at one edge of the lid plate 100*t*. When the lid plate 100*t* is rotatably coupled to the crib 100, the lid plate 100*t* may be detachable from the crib 100.

When closed, the lid plate 100*t* may substantially cover the entire opening of the crib 100, as shown in FIG. 3A. The crib 100 may include one or more locking units (not shown) that retain the lid plate 100*t* in substantially the closed position. The one or more locking units may include a clip, a belt, an adjustable fastener, a zipper, etc. Further, the crib 100 may include one or more handles (not shown) on the exterior of the crib 100 to enable the crib 100 to more easily be carried by a user when the lid plate 100*t* is in the closed position. While one lid plate 100*t* is shown in FIGS. 3A and 3B, the lid plate may be composed of a plurality of lid plates that each cover a different part of the opening of the crib 100. For example, when the crib is implemented to retain two pairs of high-heeled shoes, there may be a lid plate for each of the two pairs of high-heeled shoes.

The lid plate 100*t* may be constructed using substantially the same material as the crib 100 and may similarly have a liner, such as the liner described above for the crib 100. Alternatively, the lid plate 100*t* may be constructed differently from the crib 100. The lid plate 100*t* may be soft, rigid, or semi-rigid and may include a support structure. Here, the lid plate 100*t* may be constructed of cloth, leather, wood, fiberglass, carbon fiber, metal, plastic, any other textile, or a combination thereof. In addition, the lid plate 100*t* may be constructed of an elastic, flexible or otherwise expandable material so that when the lid plate 100*t* is in a closed position, the lid plate 100*t* may adjust for the height of the one or more items of at least one of apparel and accessories. In addition, this may enable the lid plate 100*t* to be self-adjusting as a whole so that if the contents of the crib 100 come into contact with the lid plate 100*t*, the contact with the contents causes at least the part of the lid plate 100*t* in contact with the contents to rise out. When at least a part of the lid plate 100*t* raises out, other parts of the lid plate 100*t* may retract in. Also, at least part of the lid plate 100*t* may be deformed inward when an external force is applied thereto. In addition, while the lid plate 100*t* has been described as a plate, one side or both sides of the lid plate 100*t* may be non-planer. For example, the lid plate 100*t* may have a curved shape on its side that defines the exterior of the crib 100.

As shown in FIG. 3B, the lid plate 100*t* may be rotated from the closed position into the open position about its coupling to the back plate 100*k*. When the lid plate 100*t* is fully rotated away from the opening of the crib, the lid plate 100*t* is in an adjacent and substantially parallel relationship with respect to the back plate 100*k*. When the lid plate 100*t* is fully rotated away from the opening of the crib and in the adjacent and substantially parallel relationship with respect to the back plate 100*k*, the lid plate extends further than where the back plate 100*k* is coupled to the bottom plate 100*b*. In the fully open position, the lid plate 100*t* may serve to prop up a back end of the crib 100 so that, when the crib 100 is set on a surface, the crib 100 is presented such that the bottom plate 100*b* is disposed at an angle with respect to the surface. In other words, when the lid plate 100*t* is in the fully open position and the crib 100 is set on the surface, the surface is in contact with an edge of the lid plate and a front portion of the bottom plate 100*b*, thereby causing the bottom plate to be disposed at an angle with respect to the surface the crib is set upon. Herein, the edge of the lid plate and a front portion of the bottom plate 100*b* may include a liner thereat for at least one of preventing skidding of the crib 100 relative to the surface and protecting the crib 100 from being damaged by the surface the crib 100 is sitting upon. The crib 100 may further include a lid plate retainer (not shown) that retains the lid plate 100*t* in the adjacent and substantially parallel relationship with respect to the back plate when the lid plate is fully rotated away from the opening of the crib 100.

The features of the crib 100 and the lid plate 100*t* described above are applicable to any crib described herein. However, for conciseness in explanation, a description of those features may not be repeated hereafter. The crib 100 may include one or more dividers disposed in receptacle of the crib 100. An exemplary implementation of the divider is described below with reference to FIG. 4.

Figure 4:
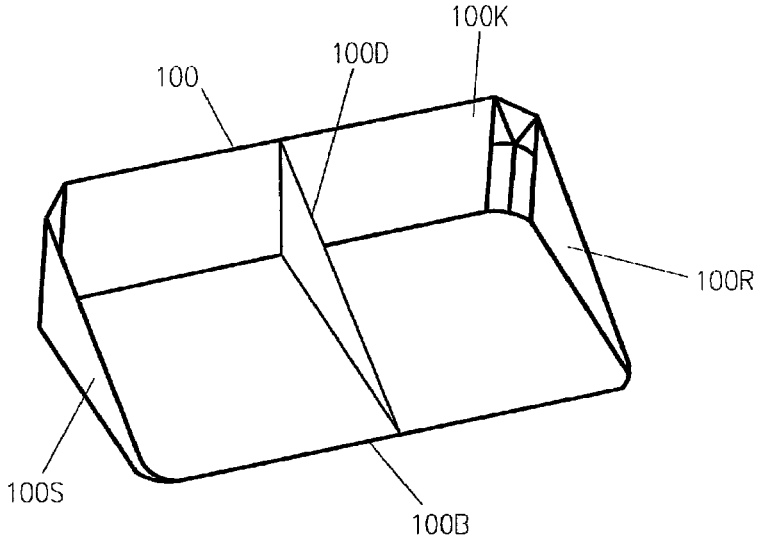
FIG. 4 is a perspective view of a crib including a divider according to an exemplary embodiment of the present invention.

FIG. 4 is a perspective view of a crib including a divider according to an exemplary embodiment of the present invention.

Referring to FIG. 4, crib 100 includes a divider 100*d*. The shape of the divider 100*d* may correspond to the shape of, and may face, the first side plate 100*s* and the second side plate 100*r*. The divider 100*d* may be coupled to, or formed with, at least one of the back plate 100*k* and the bottom plate 100*b*. The divider 100*d* may be fixedly or removably attached to at least one of the back plate 100*k* and the bottom plate 100*b*. If the divider 100*d* is implemented so as to be removably attachable, a fastener (not shown) may be employed to facilitate the divider 100*d* being removably attachable. The fastener may be Velcro. Alternatively, the fastener may be a structure disposed on, or formed as part of, at least one of the divider 100*d*, the back plate 100*k* and the bottom plate 100*b*. For example, the fastener may be a hook formed as part of the divider 100*d* that hooks into a slot formed in one of the back plate 100*k* and the bottom plate 100*b*. Herein, any number of dividers 100*d* may be employed in the crib 100.

The divider 100*d* may be constructed using substantially the same material or a different material from the crib 100 and may similarly have a liner, such as the liner described above for the crib 100. In addition, while the divider 100*d* is shown in FIG. 4 as being planer, one side or both sides of the divider 100*d* may be non-planer. For example, the divider 100*d* may have a curved shape on both of its sides.

The features of the crib 100 and the divider 100*d* described above are applicable to any crib described herein. However, for conciseness in explanation, a description of those features may not be repeated hereafter. According to an exemplary embodiment of the present invention two cribs may be attached to each other at their openings, an example of which is described below with reference to FIGS. 5A and 5B.

Figure 5A:
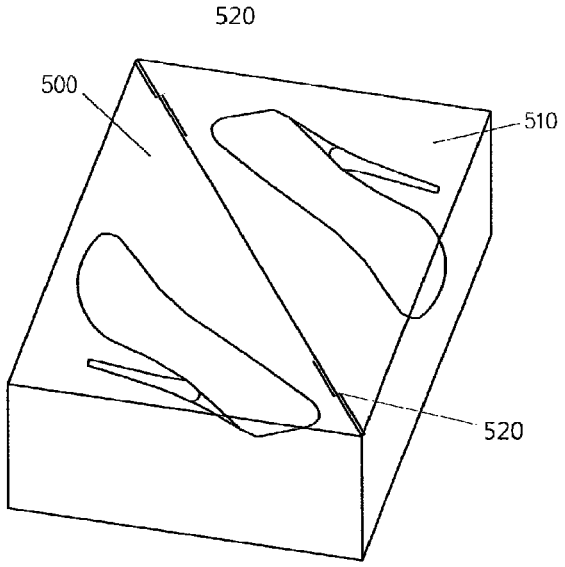
FIG. 5A is a perspective view of two attached cribs that are attachable to each other according to an exemplary embodiment of the present invention.
Figure 5B:
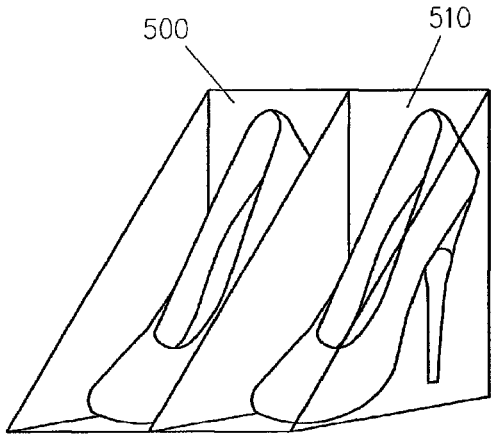
FIG. 5B is a perspective view of two detached cribs that are attachable to each other according to an exemplary embodiment of the present invention.

FIGS. 5A and 5B are perspective views of two cribs that are attachable to each other according to an exemplary embodiment of the present invention. More specifically, FIG. 5A is a perspective view of two attached cribs that are attachable to each other according to an exemplary embodiment of the present invention. FIG. 5B is a perspective view of two detached cribs that are attachable to each other according to an exemplary embodiment of the present invention.

Referring to FIG. 5B, a crib 500 and a crib 510 are shown adjacent to one another. Each of the crib 500 and the crib 510 may be constructed substantially the same as each other or differently from each. Also, each of the crib 500 and the crib 510 may include any of the features of crib 100 described herein. Here, one or both of the crib 500 and the crib 510 may include one or more retainers 520 for retaining the crib 500 and the crib 510 together at their openings, as shown in FIG. 5A. The one or more retainers 520 may be constructed as part of one or both of the crib 500 and the crib 510 or may be separate structures disposed on one or both of the crib 500 and the crib 510. Herein, one or both of the crib 500 and the crib 510 may include one or more handles (not shown) on the exterior thereof that enable the crib 500 and the crib 510, when attached together, to more easily be carried by a user. When the crib 500 and the crib 510 are attached together, they may also be disposed in any article used to store, transport, or display items, such as a case, a garment bag, etc. Herein, at least one of the crib 500 and the crib 510 may include an attachment mechanism (not shown) for hanging the crib 500 and the crib 510, when attached together, from/in a garment bag, on a hook, on a rod, on a clothing rack, etc.

According to an exemplary embodiment of the present invention a case may be employed that retains two or more cribs, an example of which is described below with reference to FIGS. 6A-6D.

Figure 6A:
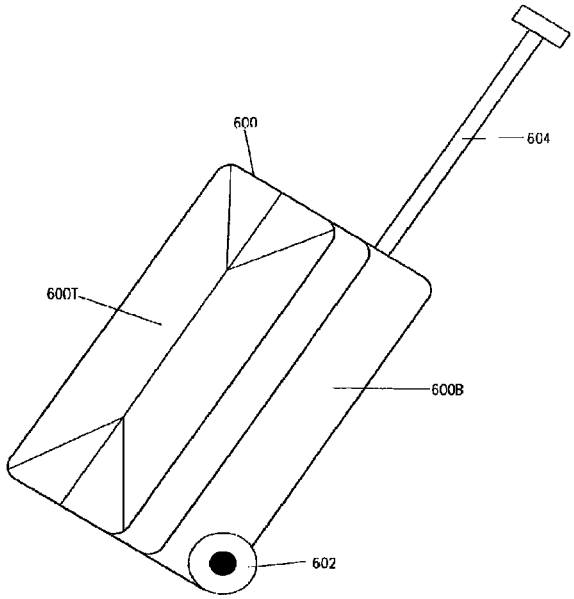
FIG. 6A is a perspective view of a case in a closed position according to an exemplary embodiment of the present invention.
Figure 6B:
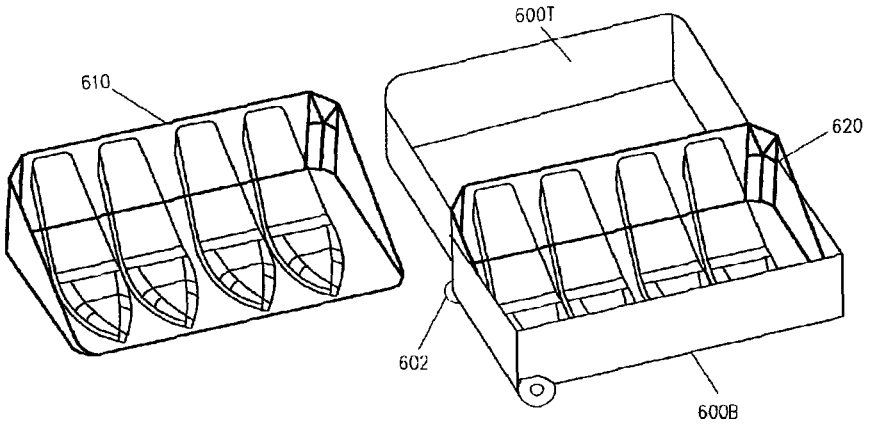
FIG. 6B is a perspective view of a case in an open position having one crib inserted therein according to an exemplary embodiment of the present invention.
Figure 6C:
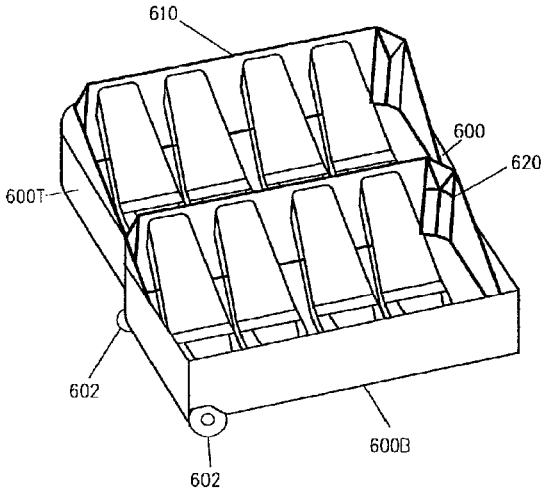
FIG. 6C is a perspective view of a case in an open position having two cribs inserted therein according to an exemplary embodiment of the present invention.
Figure 6D:
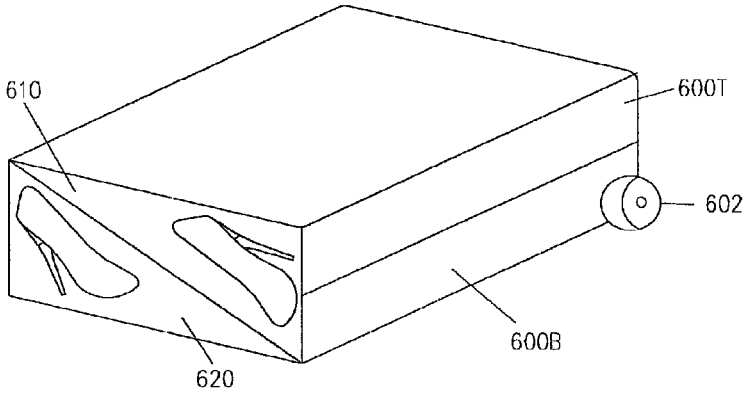
FIG. 6D is a cut away view of a case in a closed position having two cribs disposed therein according to an exemplary embodiment of the present invention.

FIGS. 6A-6D are perspective views of a case that retains two cribs according to an exemplary embodiment of the present invention. More specifically, FIG. 6A is a perspective view of a case in a closed position according to an exemplary embodiment of the present invention. FIG. 6B is a perspective view of a case in an open position having one crib inserted therein according to an exemplary embodiment of the present invention. FIG. 6C is a perspective view of a case in an open position having two cribs inserted therein according to an exemplary embodiment of the present invention. FIG. 6D is a cut away view of a case in a closed position having two cribs disposed therein according to an exemplary embodiment of the present invention.

Referring to FIG. 6A, a case 600 is shown in a closed orientation and includes a top portion 600*t* and a bottom portion 600*b*. Here, the terms 'top' and 'bottom' are merely used for convenience in explanation and do not limit one portion of the case 600 as being the top and the other portion of the case 600 being the bottom. The case 600 may include one or more rolling wheels 602 for enabling a user to more easily move the case 600. The case 600 may include a retractable pull handle 604 for enabling a user to more easily move the case 600. The retractable pull handle 604 may be a retractable 'T' bar. The retractable pull handle 604 may include any of a variety of styles or designs. For example, when the retractable pull-handle 604 is the 'T' bar, both ends of the 'T' bar may have a jeweled shaped and/or stylized buttons applied thereto.

In addition, the case 600 may include one or more carrying handles (not shown) for enabling a user to more easily carry the case 600. Also, the case 600 may include a locking system (e.g., latches or a zipper) to lock the case in the closed position. Furthermore, the case 600 may include one or more hinges (not shown) that rotatably couple the top portion 600*t* and the bottom portion 600*b*.

The exterior dimensions of the case 600 may comport with airline and/or regulatory requirements and for carry-on luggage. For example, if the airline and/or regulatory requirements for carry on luggage is a combined length of 45" for each of the three dimensions (i.e. height, width, length), the exterior dimensions of the case 600 may be 22"×14"×9."

One or both of the top portion 600*t* and the bottom portion 600*b* of the case 600 may be constructed to be a rigid shell or a soft shell. When one or both of the top portion 600*t* and the bottom portion 600*b* of the case 600 is constructed to be a rigid shell, the one or both of the top portion 600*t* and the bottom portion 600*b* may be constructed from one or more of metal (e.g. aluminum), leather, carbon fiber, fiberglass, wood, plastic (e.g., nylon, injection molded plastic and vacuum formed plastic), etc. When one or both of the top portion 600*t* and the bottom portion 600*b* of the case 600 is constructed with a soft outer surface, the one of the top portion 600*t* and the bottom portion 600*b* with the soft outer surface may have a hard shell inner protective case.

When one of the top portion 600*t* and the bottom portion 600*b* of the case 600 is constructed to be the rigid shell and the other of the top portion 600*t* and the bottom portion 600*b* of the case 600 is constructed to be soft sided, the portion that includes the rigid shell may be where both the crib 610 and the crib 620 are disposed and may include a cover that internally separates the two portions of the case 600. The cover may be rigid, semi-rigid, or soft.

The exterior of the case 600 may include any of a variety of styles or designs and may include one or more logos. For example, as shown in FIG. 6A, the top portion 600*t* may be stylized so as to resemble an emerald cut diamond. The stylizing may be accomplished by either shaping the surface of the exterior of top portion 600*t* of the case 600, such as with shallow indentations, or by applying a colored surface to the exterior of the top portion 600*t* of the case 600 that indicates the diamond surface.

Referring to FIGS. 6B and 6C, the case 600 is shown in an open orientation. In FIG. 6B, the crib 620 is shown disposed in the bottom portion 600*b* and the crib 610 is shown removed from and set adjacent to the case 600. In FIG. 6B, the crib 620 is shown disposed in the bottom portion 600*b* and the crib 610 is shown disposed in the top portion 600*t*. Each of the crib 610 and the crib 620 may be constructed substantially the same as each other or differently from each. Also, each of the crib 610 and the crib 620 may include any of the features of cribs 100, 500, or 510 described above. Here, each of the crib 610 and the crib 620 has two pairs of shoes disposed therein. Although one crib is shown and described herein as being disposed in each of the bottom portion 600*b* and the top portion 600*t*, any number of cribs may be installed in each of the bottom portion 600*b* and the top portion 600*t*. When a plurality of cribs is installed in the case, the cribs may be installed front to back, side by side, or in a grid.

One or both of the bottom portion 600*b* and the top portion 600*t* may include a locking system for one or more cribs. For example, with respect to the bottom portion 600*b* and the crib 620, the shallow end of a crib 620 may be placed in the bottom portion 600*b* and may hook under a built in ledge in the side of the bottom portion 600*b*. The tall end of the crib 620 may have at least one snap lock mechanism that snaps into place at the back of the bottom portion 600*b*. The locking system for the top portion 600*t* and the crib 610 may be similarly constructed. Accordingly, the crib 610 and crib 620 and their contents may be held in place regardless of orientation.

Alternatively or additionally, the crib 620 and crib 610 may be held in the bottom portion 600*b* and the top portion 600*t*, respectively, by using magnets. For example, with respect to the bottom portion 600*b* and the crib 620, magnets may be disposed at one or more locations on the crib 620 and/or on the bottom portion 600*b*. When magnets are disposed on one of the crib 620 and the bottom portion 600*b*, a magnetic material may be correspondingly disposed in the other one of the crib 620 and the bottom portion 600*b*. The magnets may be similarly used for the top portion 600*t* and the crib 610.

Herein, the shape of the bottom portion 600*b* and the top portion 600*t*, and the crib 620 and crib 610, may respectively be substantially the same. For example, when the corners of the bottom portion 600*b* are rounded at the joining edges, the corners of the crib 620 may be correspondingly rounded. In addition, when the internal shapes of the bottom portion 600*b* and the top portion 600*t* are different, each of the crib 620 and the crib 610 may be shaped differently to fit the interior of the corresponding one of the bottom portion 600*b* and the top portion 600*t*.

Moreover, the crib 610 and the crib 620 should be oriented in the same direction when the case 600 is in the open position, as shown in FIG. 6C. Having the crib 610 and the crib 620 oriented in the same direction when the case 600 is in the open position allows the crib 610 and the crib 620 to nest with each other when the case 600 is in a closed orientation, as shown in FIG. 6D. When the case 600 is in a closed orientation and the crib 610 and the crib 620 are nested with each other, the crib 610 and the crib 620 are upside down and oriented in the opposite direction with respect to each other.

In another exemplary embodiment of the present invention, one or both of the crib 620 and the crib 610 may be fixedly attached in the bottom portion 600*b* and the top portion 600*t* or formed with each of the bottom portion 600*b* and the top portion 600*t*. Here, the bottom portion 600*b* and the top portion 600*t* may be separable. Separation of the bottom portion 600*b* and the top portion 600*t* may be accomplished via a zipper or a separable hinge.

In another exemplary embodiment of the present invention, any number of the features described above with respect to any of the exemplary embodiments of the present invention may be employed in a travel or storage container, such as a bag, hat box, garment back, purse, backpack, etc.

Exemplary embodiments of the present invention allow for at least one of the transport, storage, and display of one or more items of at least one of apparel and accessories.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An apparatus for at least one of transport, storage, and display of one or more items of at least one of apparel and accessories, the apparatus comprising:

at least one crib defined by a bottom plate, a back plate, and first and second side plates, the at least one crib for having disposed therein the one or more items of the at least one of apparel and accessories, the at least one crib comprising:

the bottom plate that is one of square and rectangular in shape;

the back plate that is one of square and rectangular in shape; and the first and second side plates that have a same shape and that are facing each other, wherein each of the back plate and first and second side plates are perpendicular to the bottom plate, wherein one edge of each of the back plate and first and second side plates is coupled to a respective one edge of the bottom plate, wherein one edge of each of the first and second side plates is coupled to a respective one edge of the back plate, and wherein an opening of the crib is defined by one edge of each of the bottom plate, the back plate, and the first and second side plates; and a closable case including first and second portions, wherein one or more of the at least one crib is at least one of fixedly and removably retained at an interior of at least one of the first and second portions of the case, wherein, when each of the first and second portions of the case have the one or more of the at least one crib retained therein, and if the case is in an open position, the one or more of the at least one crib in each of the first and second portions of the case are upright and oriented in the same direction, and if the case is in a closed position, the one or more of the at least one crib in the first portion of the case is upside down and oriented in the opposite direction with respect to the one or more of the at least one crib in second portion of the case.

2. The apparatus of claim 1, wherein the first and second side plates are each triangular in shape.

3. The apparatus of claim 1, wherein the at least one crib further comprises a lid plate for selectively covering the opening of the crib.

4. The apparatus of claim 3, wherein the lid plate comprises an expandable material to adjust for a height of the one or more items of the at least one of apparel and accessories disposed in the crib.

5. The apparatus of claim 3, wherein one edge of the lid plate is rotatably coupled to the back plate, wherein, when the lid plate is fully rotated away from the opening of the crib, the lid plate is an adjacent and parallel relationship with respect to the back plate, wherein, when the lid plate is fully rotated away from the opening of the crib and in an adjacent and parallel relationship with respect to the back plate, the lid plate extends further than the back plate so as to cause the crib, when set on a flat surface, to rest on one edge of each of the lid plate and the bottom plate, thereby causing the bottom plate to be disposed at an angle with respect to the flat surface the crib is set on.

6. The apparatus of claim 5, wherein the adjacent parallel relationship of the lid plate with respect to the back plate when the lid plate is fully rotated away from the opening of the crib is retainable.

7. The apparatus of claim 1, wherein at least one of the bottom plate, the back plate, and the first and second side plates comprises one or more retainers that retain the one or more items of the at least one of apparel and accessories in the crib.

8. The apparatus of claim 7, wherein the one or more retainers comprise a strap, at least one end of the strap being coupled to the at least one of the bottom plate, the back plate, and the first and second side plates.

9. The apparatus of claim 8, wherein the one or more retainers comprise one or more fasteners for coupling two straps together.

10. The apparatus of claim 1, wherein the at least one crib further comprises one or more dividers that face the first and second side plates and that are coupled to at least one of the bottom plate and the back plate.

11. The apparatus of claim 1, wherein the at least one crib is constructed of at least one of a rigid and semi-rigid material.

12. The apparatus of claim 1, wherein the at least one crib further comprises a liner covering all or a portion of at least one of the bottom plate, the back plate, and the first and second side plates.

13. The apparatus of claim 1, wherein the at least one crib comprises two cribs that are removably attachable at their openings.

14. The apparatus of claim 1, wherein the one or more of the at least one crib is removably retained at the interior of the at least one of the first and second portions of the case using magnetism.

15. The apparatus of claim 8, wherein the one or more retainers comprise one or more protectors that protect the one or more items of the at least one of apparel and accessories from the strap while being retained by the strap.

16. The apparatus of claim 8, wherein the at least one end of the strap is coupled to the at least one of the bottom plate, the back plate, and the first and second side plates via a slider that is moveable along a track disposed at the at least one of the bottom plate, the back plate, and the first and second side plates, the track being parallel to the first and second side plates.

17. The apparatus of claim 16, wherein the track comprises at least one of a rail disposed on, and a slot form in, the at least one of the bottom plate, the back plate, and the first and second side plates.

* * * * *